US007960689B2

(12) United States Patent
Landrock et al.

(10) Patent No.: US 7,960,689 B2
(45) Date of Patent: Jun. 14, 2011

(54) METHOD AND SYSTEM FOR INTERNAL CHEMICAL IONIZATION WITH WATER IN ION TRAP MASS SPECTROMETRY

(76) Inventors: Andreas Landrock, Dresden (DE); Klaus Richter, Dresden (DE)

( * ) Notice: Subject to any disclaimer, the term of this patent is extended or adjusted under 35 U.S.C. 154(b) by 197 days.

(21) Appl. No.: 12/457,312

(22) Filed: Jun. 6, 2009

(65) Prior Publication Data

US 2010/0308217 A1 Dec. 9, 2010

(51) Int. Cl.
*H01J 49/26* (2006.01)

(52) U.S. Cl. ..... 250/281; 250/282

(58) Field of Classification Search ..... 250/281, 250/282

See application file for complete search history.

(56) References Cited

U.S. PATENT DOCUMENTS 5,261,937 A * 11/1993 Jiang et al. ..... 96/101
7,064,323 B2 * 6/2006 Yamakoshi et al. ..... 250/293

OTHER PUBLICATIONS

A. Landrock et al., Fresenius J. Anal. Chem. 1995, vol. 351, pp. 536-543.

* cited by examiner

*Primary Examiner* — Kiet T Nguyen
(74) *Attorney, Agent, or Firm* — Katrin Venter

(57) ABSTRACT

Method and system that allows the use of water as reactant gas for internal chemical ionization in mass spectrometry. The system provides a stable water vapor pressure in the ion trap by condensation-free water vapor flow between water reservoir and ion trap. The system can be implemented by modification of any type of ion-trap mass spectrometer designed for internal chemical ionization.

17 Claims, 3 Drawing Sheets

Schematic Diagram of the Water CI Module

Schematic Diagram of the conventional CI Module

Schematic Diagram of the Water CI Module

METHOD AND SYSTEM FOR INTERNAL CHEMICAL IONIZATION WITH WATER IN ION TRAP MASS SPECTROMETRY

FIELD OF THE INVENTION

The present invention relates to a mass spectrometer with internal chemical ionization of an analyte with water and a method of operating said ion mass spectrometer.

BACKGROUND OF THE INVENTION

In mass spectrometry it is essential to convert the analyte molecules into ions. The most conventionally known method to create ions for mass spectrometry is electron ionization (EI), where ions are usually produced by electron impact at 70 eV. During electron ionization, positively charged molecular ions are formed having often a much higher energy then required for actual ionization which causes in most cases further fragmentation of the analyte molecules. The fragmentation also leads to numerous smaller single fragments causing an increase in the chemical background.

A softer method for sample ionization is known as chemical ionization (CI), where in an initial step a reactant gas is ionized by electron ionization and in a further step, the reactant gas ions collide with the analyte molecules thereby ionizing the analyte molecules. Typical reactant gases are, for example, methane, methanol, and i-butane. The dominating signal in the CI-mass spectrum is created by positively charged analyte-molecule ions formed by proton transfer from the reactant-gas ion to the analyte-molecule.

It is generally known that water qualifies as reactant gas. With a proton affinity of 723 kj/mol, water has, next to methane, the second strongest protonation ability of all CI-gases. Water can therefore protonate almost all organic substances. A further advantage of water is that it does not react with nitrogen, argon, oxygen and carbon dioxide because these gases have a lower proton affinity then water. Moreover, the low molecular weight of the water reactant gas ion, $H_3O^+$, allows spectra signals with a m/z ratio of 21, which makes it possible to detect low molecular substances such as, HCN, HCHO, $CH_3OH$, or $H_2S$, which cannot be identified with other reactant gases because of their higher molecular weight.

The problem of using water for chemical ionization is the difficulty to establish constant water vapor pressure conditions in the trap. Because the chemical ionization of an analyte is initiated by collision of the CI gas ions and the analyte molecules, pressure variations of the CI gas drastically influence the quality and quantity of the signals in the mass spectrum and precise analysis results. Because water has a low vapor pressure at room temperature, it easily condenses in the thin connection pipes as a result of minor temperature variations, finally also causing pressure variations in the trap.

Water has found some application in external chemical ionization, i.e., before entering the mass spectrometer, but this requires complex additional constructions.

Commercial ion trap mass spectrometers for chemical internal ionization do not provide the necessary conditions for the use of water as reactant gas. Because of the low vapor pressure of water, minor temperature changes may cause condensation of water drops in the pipe between the water reservoir and the entrance valve of the trap leading to an instable water pressure in the trap. In order to successfully use water as reactant gas for the internal chemical ionization of an analyte, it is essential to maintain a constant water vapor pressure in the ion trap Because of the many advantages of water as reactant gas for the chemical ionization, there is a need of designing an ion trap mass spectrometer which can provide a stable water vapor pressure in the ion trap in order to obtain high quality and reliable spectra.

SUMMARY OF THE INVENTION

The present invention is directed to an ion trap mass spectrometer for the chemical ionization of an analyte with water, wherein the spectrometer comprises an ion trap, a water reservoir, a connection through which water vapor from the water reservoir can pass to the ion trap, a mass analyzer, and a detector, wherein the connection allows a condensation-free passage of water vapor therethrough.

In one aspect, the connection through which water vapor from the water reservoir can pass to the ion trap comprises a pipe which connects the water reservoir with a vacuum resist valve and with a solenoid valve adjacent to the ion trap. In a preferred aspect, the vacuum resist valve comprises a needle valve. In a still further aspect, the vacuum resist valve allows regulating the water vapor pressure in a range of from about 0 to about 100 microtorr.

In another preferred aspect, the pipe may comprise metal, most preferably at least one of copper or steel. Preferably, the pipe has an internal diameter of at least about ⅛ inch and not higher than about ¼ inch. In still another aspect, the pipe has a total length of not more than about 10 cm.

In yet another aspect, the water reservoir may have a volume of at least about 0.5 $cm^3$ and not more than about 10 $cm^3$.

In another aspect, the ion trap of the mass spectrometer may be connected to a gas chromatograph.

The present invention is also directed to a method of stabilizing the water vapor pressure in an ion trap mass spectrometer which uses chemical ionization of an analyte with water, wherein the method comprises providing a connection between a water reservoir and the ion trap, which connection allows water vapor to pass from the reservoir to the ion trap substantially without undergoing condensation.

In one aspect, the variation of the water vapor pressure during operation of the spectrometer may not be higher than about 1%.

In a still further aspect, during operation of the mass spectrometer the temperature of the water in the water reservoir and the connection is kept substantially constant.

The present invention also provides a method of determining the presence of an analyte with an ion trap mass spectrometer which uses chemical ionization with water as reactant gas, wherein the method comprises connecting a reservoir for the water to the ion trap in such a way that water vapor from the reservoir passes into the ion trap substantially without undergoing condensation.

BRIEF DESCRIPTION OF THE DRAWINGS

The present invention is further described in the detailed description which follows, in reference to the noted plurality of drawings by way of non-limiting examples.

DETAILED DESCRIPTION

The particulars herein are by way of example and for purpose of illustrative discussion of the embodiments of the present invention only and are presented in the cause of providing what is believed to be the most useful and readily understood description of the principles and conceptual aspects of the present invention. In this regard, no attempt is made to show details of the present invention in more detail than is necessary for the fundamental understanding of the present invention, the description making apparent to those skilled in the art how the several forms of the present invention may be embodied in practice.

Except where otherwise indicated, all numbers expressing quantities of reaction conditions, ingredients, and so forth used in the specification and claims are to be understood as being modified in all instanced by the term "about."

The present invention is directed to an ion trap mass spectrometer for internal chemical ionization of an analyte with water as reactant gas and a method of determining the presence of an analyte by using said ion trap mass spectrometer.

In order to work with water as reactant gas for the internal chemical ionization in mass spectrometry, a stable water vapor pressure in the ion trap needs to be provided. According to the present invention, stable water vapor pressure conditions in the ion trap can be achieved by connecting the ion trap with a water reservoir over a (preferably pipe) connection which allows a condensation free water vapor flow, and regulating the amount of water vapor in the trap with a vacuum sealed valve. Water condensation free in accordance to the present invention means that the water vapor pressure in the ion trap does not vary by more than about 1% pressure, e.g., not more than about 0.5%, or not more than about 0.2%.

Figure 1:
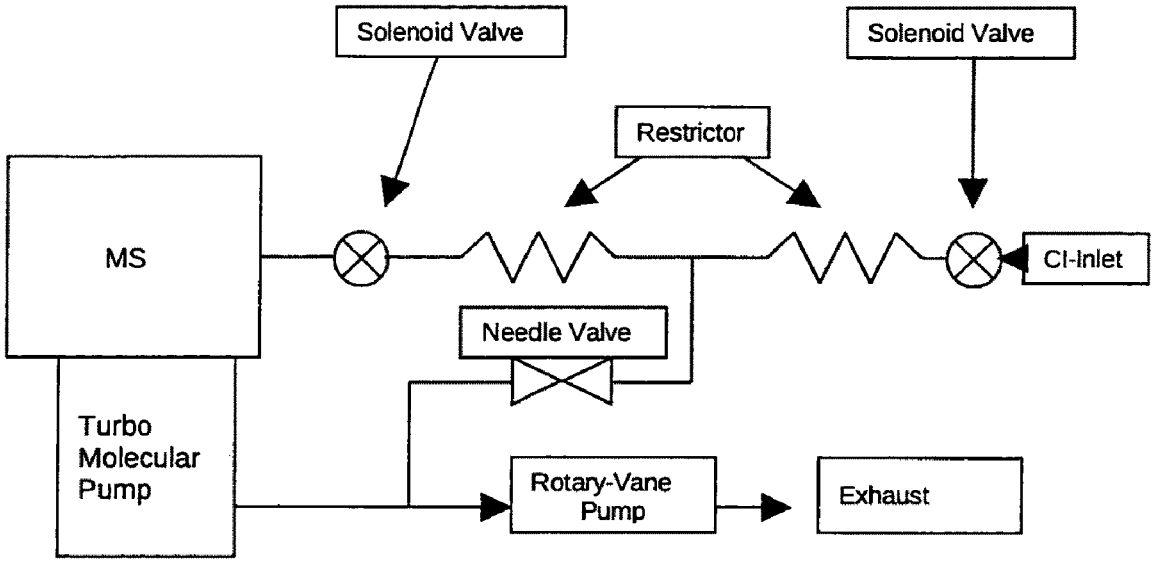
FIG. 1 is a schematic diagram, showing an example of a conventional ion trap mass spectrometer for chemical ionization of an analyte.

FIG. 1 demonstrates an example of a conventional CI module, as present in the MS Saturn 2000 of Varian. In this case, the reactant gas (e.g., methane) or liquids with high vapor pressure (e.g., methanol) sourced from a reservoir are passed through a shutoff valve via a thin steel pipe of about 1/16 inch inside diameter and a restrictor through a needle valve. Downstream of the needle valve, the reactant gas passes a second restrictor until the pipe reaches another shutoff valve which opens and closes the entrance to the ion trap.

Figure 2:
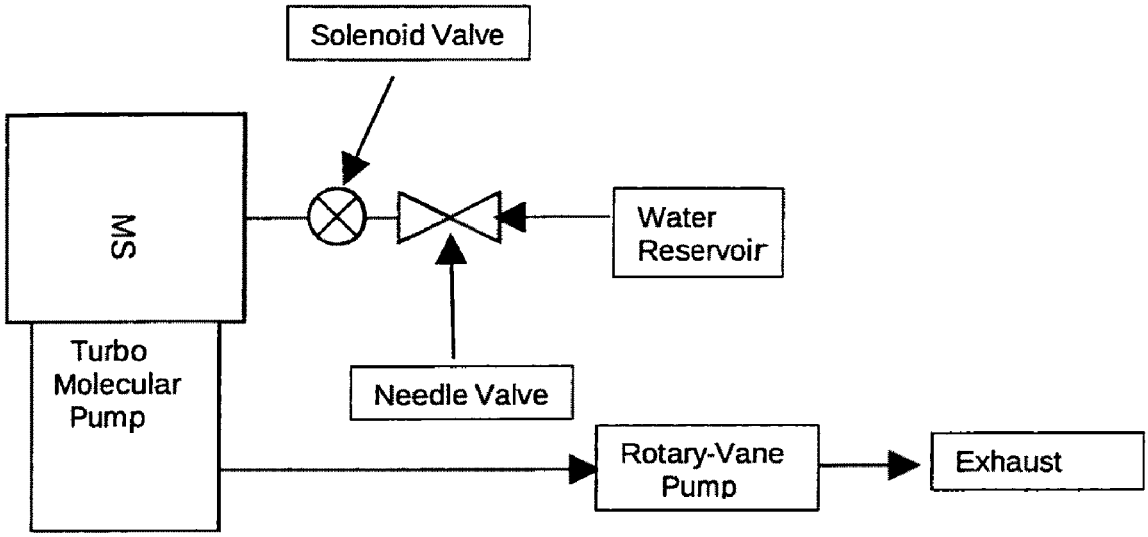
FIG. 2 is a schematic diagram, showing the ion trap mass spectrometer for chemical ionization of an analyte with water as reactant gas according to the present invention.

In comparison, the schematic diagram in FIG. 2 shows an example of an ion trap mass spectrometer for chemical ionization of an analyte with water as reactant gas according to the present invention. In this case, the water reservoir is connected via a pipe with a thickness of at least about 1/8 inside diameter to a needle valve in the absence of a resistor, which guarantees a substantially water condensation free connection. Downstream of the needle valve, the pipe is connected to a shut off valve at the entrance to the ion trap. The connection between the needle valve and the shut off valve also does not include a restrictor and should be designed to be as short as possible.

The present invention has the advantage that it may be implemented by modification of any type of ion-trap mass spectrometer designed for chemical ionization.

According to the present invention, in order to avoid water condensation in the pipe, the inside diameter of the pipe needs to be at least about 1/8 inch. There is no specific upper limit of the of the pipe diameter. The preferred range of the inside pipe diameter is from about 1/2 inch to about 1/8 inch. Most preferable is an inside diameter range of from about 1/4 inch to about 1/8 inch.

The length of the connection through which water vapor from the water reservoir can pass to the ion trap should be designed as short as possible, however, for practical reasons depends on the design of the ion trap mass spectrometer to be modified. The preferred length is not more than about 50 cm, e.g., not more than about 30 cm, and most preferable not more than about 10 cm.

The material of the pipe may be any material appropriate for use with water vapor. Preferably, the pipe material consists of or comprises a metal and/or a metal alloy such as, e.g., stainless steel or copper.

The vacuum resist valve connected to the water reservoir has the function of regulating the water vapor current to the ion trap in order and to establish a desired stable water vapor pressure in the ion trap. The vacuum resist valve may be in a preferred embodiment a needle valve.

The water vapor in the ion trap may be regulated to a stable value between about 0 and about 100 microtorr, whereby the variation of the water vapor pressure should be not more than about 1%, e.g., not more than about 0.5%. The optimal water vapor pressure for a specific application may be established beforehand by, e.g., comparing peak sizes and quality of the mass spectra.

The water reservoir may be any reservoir that is vacuum proved and appropriate for use with water. Preferably, the water reservoir is a vacuum proved round bottom glass flask. The inside volume of the water reservoir is not critical. Preferably, the inside volume of the water reservoir is at least about 0.5 $cm^3$ and not higher than about 10 $cm^3$. An amount of about 5 ml water may last for about 3 to 4 weeks operation time of the ion trap mass spectrometer. It is preferred that the water reservoir is positioned as close as possible to the ion trap in order to allow a short connection to the ion trap and a stable temperature. Preferably, the temperature variations during performing the measurements (preferably at room temperature) do not vary by more than about more than ±1° C.

The shut off valve at the entrance to the ion trap opens and closes the water vapor connection to the ion trap. In a preferred embodiment, the shut off valve is a solenoid valve. It allows switching within seconds between CI and EI.

Figure 3:
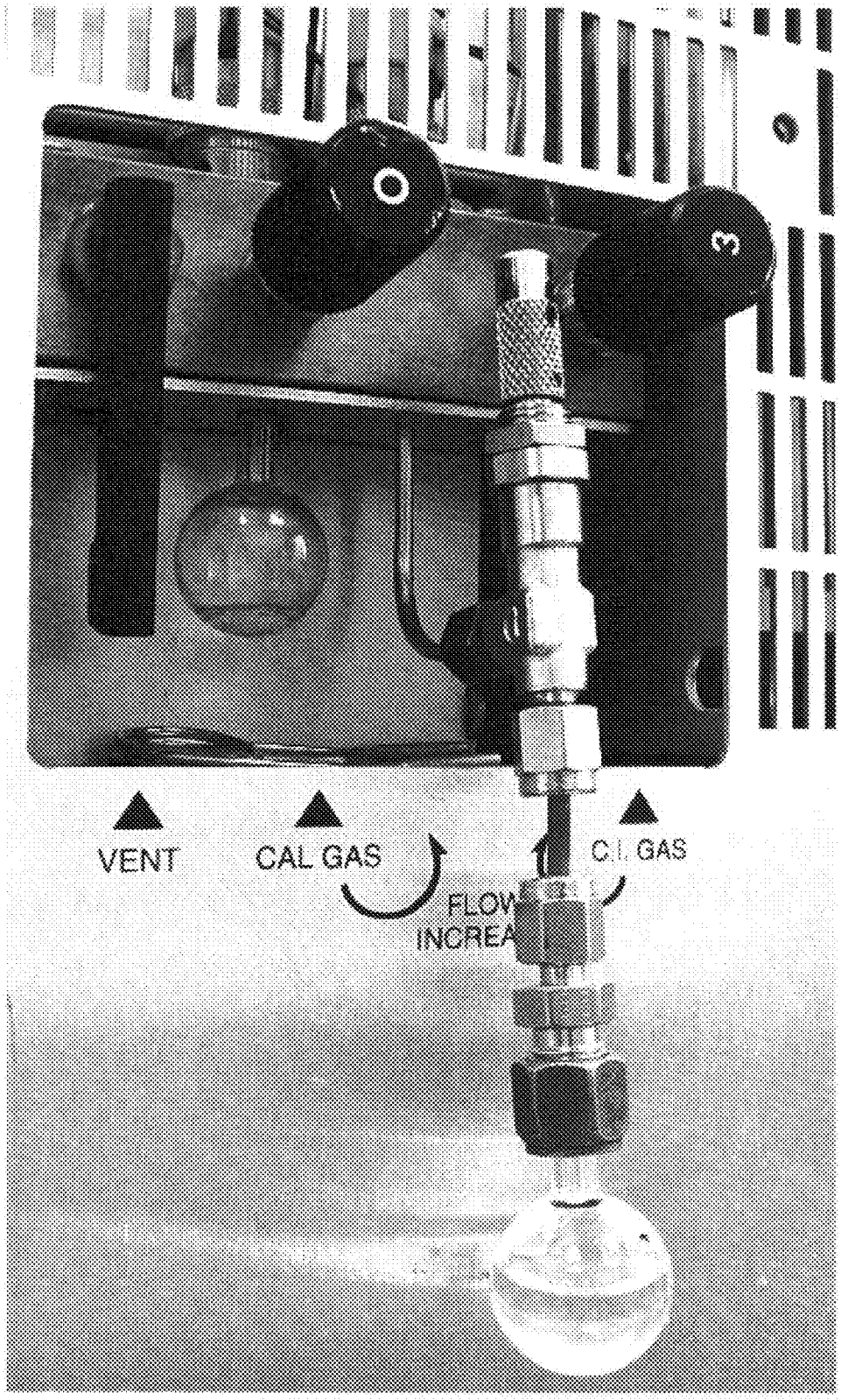
FIG. 3 is a photo which shows an example of the connection between water reservoir and ion trap according to the present invention.

A non-limiting example of a water CI module of the present invention can be seen in FIG. 3, where an Ion Trap MS Saturn 2000 has been modified for the use of water as reactant gas for the chemical ionization of an analyte.

What is claimed is:

1. An ion trap mass spectrometer for a chemical ionization of an analyte with water, wherein the spectrometer comprises
- an ion trap;
- a water reservoir;
- a connection through which water vapor from the water reservoir can pass to the ion trap;
- a mass analyzer; and
- a detector;

wherein the connection allows a condensation-free passage of water vapor therethrough.

2. The spectrometer of claim 1, wherein a water vapor pressure during an operation of the spectrometer varies by not more than about 1%.

3. The spectrometer of claim 1, wherein the connection comprises a pipe which connects the water reservoir with a vacuum resist valve and with a solenoid valve adjacent to the ion trap.

4. The spectrometer of claim 3, wherein the vacuum resist valve comprises a needle valve.

5. The spectrometer of claim 4, wherein the needle valve allows regulating a water vapor pressure in a range of from about 0 to about 100 microtorr.

6. The spectrometer of claim 3, wherein the pipe comprises a metal pipe.

7. The spectrometer of claim 6, wherein the metal comprises at least one of copper and steel.

8. The spectrometer of claim 3, wherein the pipe has an internal diameter of at least about ⅛ inch.

9. The spectrometer of claim 3, wherein the pipe has an internal diameter of not higher than about ¼ inch.

10. The spectrometer of claim 3, wherein the pipe has a length of not more than about 10 cm.

11. The spectrometer of claim 1, wherein the water reservoir has a volume of at least about 0.5 $cm^3$.

12. The spectrometer of claim 1, wherein the water reservoir has a volume of not more than about 10 $cm^3$.

13. The spectrometer of claim 1, wherein the ion trap is connected to a gas chromatograph.

14. A method of stabilizing the water vapor pressure in an ion trap mass spectrometer which uses a chemical ionization of an analyte with water, wherein the method comprises providing a connection between a water reservoir and the ion trap, which connection allows water vapor to pass from the reservoir to the ion trap substantially without undergoing condensation.

15. The method of claim 14, wherein a variation of the water vapor pressure during an operation of the spectrometer is not higher than about 1%.

16. The method of claim 14, wherein during an operation of the spectrometer a temperature of the water reservoir and the connection is kept substantially constant.

17. A method of determining the presence of an analyte with an ion trap mass spectrometer which uses a chemical ionization with water as reactant gas, wherein the method comprises connecting a reservoir for the water to the ion trap in such a way that water vapor from the reservoir can pass into the ion trap substantially without undergoing condensation.

* * * * *